United States Patent [19]

Levy et al.

[11] 4,146,394

[45] Mar. 27, 1979

[54] FILTER PACK CORRECTION METHOD IN COLOR PHOTOGRAPHY

[75] Inventors: Marilyn Levy, Little Silver; Milan Schwartz, Neptune, both of N.J.

[73] Assignee: The United States of America as represented by the Secretary of the Army, Washington, D.C.

[21] Appl. No.: 555,316

[22] Filed: Mar. 4, 1975

[51] Int. Cl.[2] ..... G03C 7/00; G03C 7/16

[52] U.S. Cl. ..... 96/2; 96/23

[58] Field of Search ..... 96/24, 23, 2

[56] References Cited

PUBLICATIONS

Focal Encyclopedia of Photography ©1972, pp. 322–323.

*Primary Examiner*—J. Travis Brown
*Assistant Examiner*—L. Falasco
*Attorney, Agent, or Firm*—Nathan Edelberg; Sheldon Kanars

[57] ABSTRACT

A method of predicting the filter pack correction required to print a color film that has been exposed at any illuminant color temperature is provided without the need for a grey card in the scene.

This method involves first the experimental determination of the correction filter pack required to produce a grey print from any of the following: the clear unexposed portion of the negative, an image of a continuous wedge or step tablet exposed at a known color temperature on a sensitometer, or the image of a grey card on a roll of film that was exposed at a known color temperature. The red, blue, and green densities of the grey card, or a particular exposure on the characteristic curve, are added to the densities of the correction filter pack to obtain a value called the Total Negative Grey. In the case of the clear portion of the negative, a correction factor of 0.02 green and 0.13 blue must be added to the base fog densities before the densities of the filter pack are added. The densities produced by the image of a grey card in a scene exposed at a different color temperature are then simulated from a simulated characteristic curve. These densities are then subtracted from the Total Negative Grey to obtain the filter pack required to print the scene exposed at a new color temperature.

4 Claims, 5 Drawing Figures

FILTER PACK CORRECTION METHOD IN COLOR PHOTOGRAPHY

The invention described herein may be manufactured, used, and licensed by or for the Government for governmental purposes without the payment to us of any royalty thereon.

This invention relates in general to a filter pack correction method required to print a color film and in particular, to a filter pack correction method required to print a color film that has been exposed at any illuminant color temperature without the need for a grey card in the scene.

BACKGROUND OF THE INVENTION

In U.S. Pat. No. 3,784,377 issued January 8, 1974 to Marilyn Levy and Richard G. LeSchander, for "Curve Analysis Method In Color Printing" there is disclosed and claimed a method whereby the clear, unexposed portion of the negative can be used instead of a grey card image to predict the filter pack required to obtain good color balance in the print. The difficulty with the U.S. Pat. No. 3,784,377 method is that it is valid only when the scene is illuminated by light of a very limited range of color temperatures. Exposures made at other color temperatures require additional printing filter corrections.

In U.S. patent application Ser. No. 555,323, filed Mar. 4, 1975, now U.S. Pat. No. 3,953,135 of Marilyn Levy and Milan Schwartz for "Curve Analysis Method In Color Photography" and assigned to a common assignee and of which this application was copending, there is disclosed and claimed a method of approximating the characteristic curves of a color film exposed at a variety of color temperatures where the characteristic curve of a film exposed at one color temperature is known.

The method involves the use of a linear curve which relates the Δ log E change of blue and green exposure with change of color temperature. This linear curve is derived experimentally from the characteristic curves obtained by exposing several color negative films to a sensitometer, including a step tablet and a means for varying color temperatures. The films are exposed at color temperatures ranging from 2900° K. to 6700° K. and then processed in a color developer. Transmission densities of the developed film to red, green, and blue light are determined with a densitometer and the results plotted as a curve relating red, blue, and green density to relative log exposure. These characteristic curves are then analyzed by placing them over the curves obtained at 6700° K. so that the red curves are superimposed. The change in blue and green exposure with color temperature for each set of curves is determined graphically along each curve. The Δ log E determinations are averaged and the results plotted as a linear curve relating the Δ log E change of blue and green exposure from 6700° K. to 2900° K. This curve can be plotted as Δ log E vs. color temperature or Mired Value, which is a value equal to 1,000,000/color temperature. This linear curve can then be used to determine the characteristic curve of an unknown color film exposed to any color temperature providing the characteristic curve for one color temperature is determined experimentally. This is done by determining from the linear curve the Δ log E change for the blue exposure and the green exposure from the experimental color temperature to the new color temperature. The change is plotted on the characteristic curve of the known temperature to produce the predicted points for the unknown curves.

SUMMARY OF THE INVENTION

The general object of the invention is to provide a method of predicting the filter pack correction required to print a film that has been exposed at any illuminant color temperature without the need for a grey card in the scene.

This method involves first the experimental determination of the correction filter pack required to produce a grey print from any of the following: the clear unexposed portion of the negative, an image of a continuous wedge or step tablet exposed at a known color temperature on a sensitometer, or the image of a grey card on a roll of film that was exposed at a known color temperature. The red, blue, and green densities of the grey card, or a particular exposure on the characteristic curve, are added to the densities of the correction filter pack to obtain a value called the Total Negative Grey. In the case of the clear portion of the negative, a correction factor of 0.02 green and 0.13 blue must be added to the base fog densities before the densities of the filter pack are added. The densities produced by the image of a grey card in a scene exposed at a different color temperature are then simulated from a simulated characteristic curve. These densities are then subtracted from the Total Negative Grey to obtain the filter pack required to print the scene exposed at a new color temperature.

DESCRIPTION OF THE PREFERRED EMBODIMENT

Figure 1:
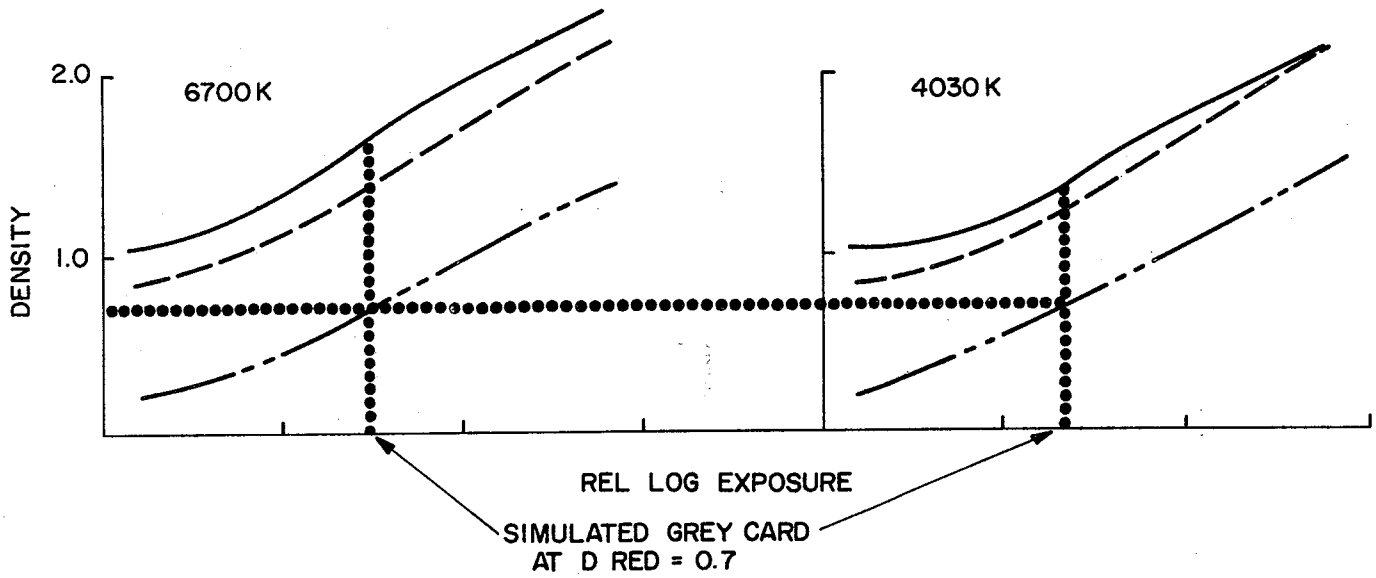
FIG. 1 illustrates the densities of a simulated gray card exposed at 6700° K. and at 4030° K., and FIG. 2 are linear curves illustrating how the blue and green densities of typical color films of a simulated grey card vary with color temperature.
Figure 2:
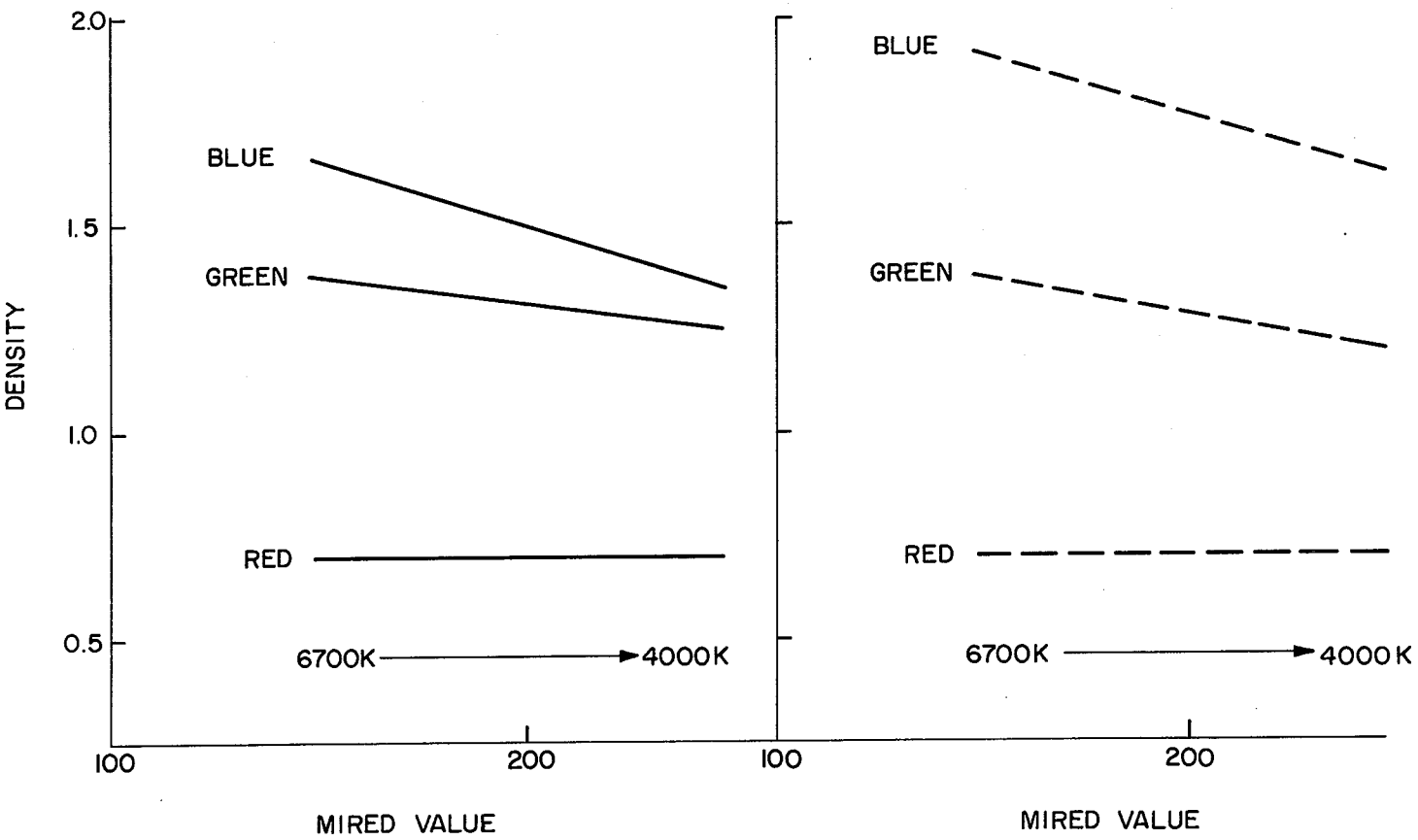

The method is based on the fact that since a grey card, by definition, has equal reflectivity to red, green and blue light, white light of a particular color temperature should be reflected from it without change into the camera provided that the lens of the camera does not absorb appreciable amounts of any particular wave length of light. It can thus be assumed that any exposure on the characteristic curve for a particular color temperature can be used to simulate the densities produced by the image of a grey card in a scene exposed at that color temperature. The manner in which a grey card is simulated is shown in FIG. 1. The curve on the left illustrates the densities of a simulated grey card exposed at 6700° K. and the curve on the right, a simulated grey card exposed at 4030° K. These curves can be obtained experimentally or simulated according to the method described in our copending application for "Curve Analysis Method in Color Photography." FIG. 2 are linear curves illustrating how the blue and green densities of two representative color films, Ektacolor-S on the left, and Kodacolor-X, on the right of a simulated grey card vary with color temperature.

These simulated grey cards can be used in the same way that actual grey cards are used to determine filter packs and filter pack corrections as shown in Table I.

TABLE I

| | RED (Cyan) | GREEN (Magenta) | BLUE (Yellow) |
|---|---|---|---|
| Simulated Grey Card Densities (Ektacolor-S at 6700K) | 0.70 | 1.38 | 1.67 |
| Add: Correction Filter Pack | | 0.26 | 0.86 |
| TOTAL NEGATIVE GREY AT D (red) = 0.70 | 0.70 | 1.64 | 2.53 |
| Subtract: Simulated Grey Densities (Ektacolor-S at 4030K) | 0.70 | 1.24 | 1.36 |
| NEW FILTER PACK | | 0.40 | 1.17 |

Referring to Table I, the correction filter required to print a grey print from the negative of a grey card exposure or a step wedge exposed to light of a known color temperature is determined experimentally. In this embodiment, the grey print of the negative image of a step wedge that has been exposed at 6700° K. requires a correction filter pack of 0.26 Magenta and 0.89 Yellow. The sum is called the Total Negative Grey. From the characteristics curve at 6700° K. and the linear curve, it is determined that the simulated grey densities at 4030° K. are 40 Magenta, 117 Yellow. This was then verified experimentally and found to be a very close prediction.

It has also been found that there is a relationship between the unexposed portion of the negative and the image of the grey card. That is, an analysis of correction filter packs required to make prints of a variety of sensitometric exposures indicates that there is a fixed relationship between the Total Base Grey Density or density of the unexposed portion of the negative plus filter pack required to produce a grey print of that portion, and the Total Negative Grey Density. That is, it has been found that by adding 0.02 Green and 0.13 Blue to the Total Base Grey Densities, one obtains the Total Negative Grey Density. The convenience of using the unexposed portion of the negative for filter pack calculations has been discussed by Levy and LeSchander in U.S. Pat. No. 3,784,377. Table II represents an illustrative example using the same film and processing conditions described in Table I:

TABLE II

| | RED (Cyan) | GREEN (Magenta) | BLUE (Yellow) |
|---|---|---|---|
| Fog Densities (Ektacolor-S) | 0.20 | 0.85 | 1.01 |
| Add: Filter Pack | | 0.27 | 0.89 |
| TOTAL BASE GREY | 0.20 | 1.12 | 1.90 |
| Add: Correction Filter | | 0.02 | 0.13 |
| TOTAL NEGATIVE GREY AT D(red) = 0.20 | 0.20 | 1.14 | 2.03 |
| Add: Neutral Density = 0.50 | 0.50 | 0.50 | 0.50 |
| TOTAL NEGATIVE GREY AT D(red) = 0.70 | 0.70 | 1.64 | 2.53 |
| Subtract: Simulated Grey Densities (Ektacolor-S at 4030K) | 0.70 | 1.24 | 1.36 |
| NEW FILTER PACK | | 0.40 | 1.17 |

Figure 3:
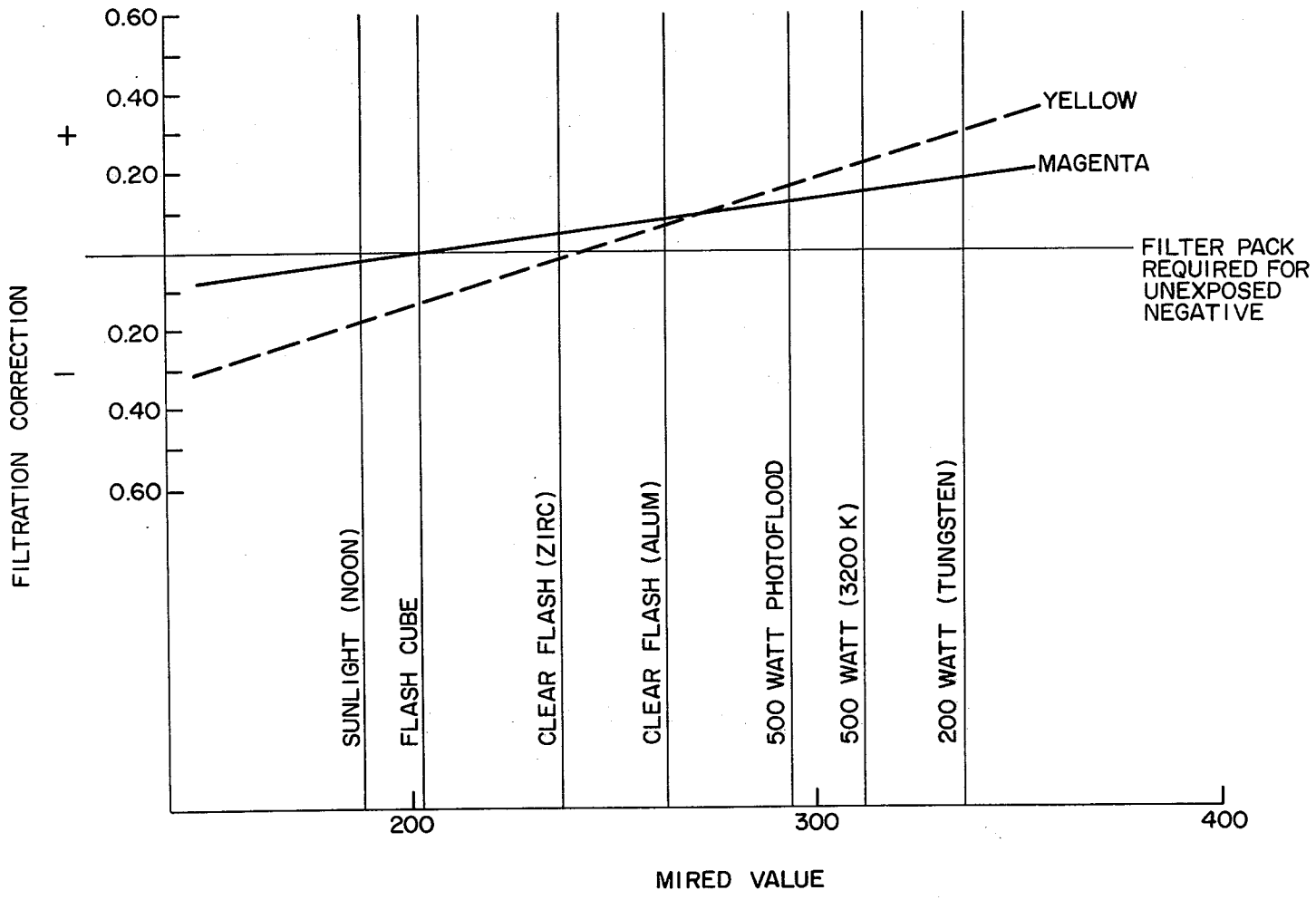
FIG. 3 is a chart for predicting the change in filtration with color temperature using the clear, unexposed portion of the negative.

A chart as shown in FIG. 3, which was derived from simulated characteristic curves at different color temperatures, can thus be drawn to conveniently predict the change in filtration with color temperature required for a particular film and processing chemistry when using the clear, unexposed portion of the negative.

We wish it to be understood that we do not desire to be limited to the exact details as described, for obvious modifications will occur to a person skilled in the art.

What is claimed is:

1. Method of predicting the filter pack correction required to print a film that has been exposed at any illuminant color temperature without the need for a grey card in the scene, said method including the steps of:

(a) experimentally determining the correction filter required to produce a grey print from the clear unexposed portion of the negative, (B) adding to the densities to red, blue and green light of the correction filter pack the densities to red, blue and green light of the base fog, (C) adding to the total densities of base fog and correction filter pack the correction densities of 0.02 green and 0.13 blue to obtain a value called the Total Negative Grey;

(D) simulating the densities of a grey card in the scene exposed at a different color temperature from the simulated characteristic curve at that color temperature, and (E) obtaining the filter pack for a scene to be printed at a new color temperature by subtracting the simulated grey card densities for the new color temperature from the Total Negative Grey.

2. Method of predicting the filter pack correction required to print a film that has been exposed at any illuminant color temperature without the need for a grey card in the scene, said method including the steps of:

(A) experimentally determining the correction filter pack required to produce a grey print from an image of a continuous wedge exposed at a known color temperature on a sensitometer, (B) adding to the densities to red, blue and green light of a simulated grey card obtained from the characteristic curve of the continuous wedge the densities to red, blue and green light of the correction filter pack to obtain a value called the Total Negative Grey, (C) simulating the densities of a grey card in the scene exposed at a different color temperature from the simulated characteristic curve at that color temperature, and (D) obtaining the filter pack for a scene to be printed at a new color temperature by subtracting the simulated grey card densities for the new color temperature from the Total Negative Grey.

3. Method according to claim 2 where the image of a grey card is used in step (A) to determine the experimental pack required for printing.

4. Method of predicting the filter pack correction required to print a film that has been exposed at any illuminant color temperature without the need for a grey card in the scene, said method including the steps of:

(A) experimentally determining the correction filter pack required to produce a grey print from an image of a step tablet exposed at a known color temperature on a sensitometer, (B) adding to the densities to red, blue and green light of a simulated grey card obtained from the characteristic curve of that step tablet the densities to red, blue and green light of the correction filter pack to obtain a value called the Total Negative Grey, (C) simulating the densities of a grey card in the scene exposed at a different color temperature from the simulated characteristic curve at that color temperature, and (D) obtaining the filter pack for a scene to be printed at a new color temperature by subtracting the simulated grey card densities for the new color temperature from the Total Negative Grey.

* * * * *